United States Patent [19]

Tanaka et al.

[11] 4,333,428

[45] Jun. 8, 1982

[54] INTERNAL COMBUSTION ENGINE

[75] Inventors: Toshiaki Tanaka, Fujisawa; Yukihiro Etoh, Yokohama, both of Japan

[73] Assignee: Nissan Motor Company, Limited, Yokohama, Japan

[21] Appl. No.: 105,104

[22] Filed: Dec. 19, 1979

[30] Foreign Application Priority Data

May 8, 1979 [JP] Japan ..... 54-1189

[51] Int. Cl.[3] ..... F02M 25/06; F01N 3/15

[52] U.S. Cl. ..... 123/198 F; 123/568

[58] Field of Search ..... 123/198 F, 568, 433, 123/303

[56] References Cited

U.S. PATENT DOCUMENTS

| | | | |
|---|---|---|---|
| 3,703,164 | 11/1972 | Weaving | 123/568 |
| 3,982,514 | 9/1976 | Turns | 123/568 |
| 4,064,861 | 12/1977 | Schulz | 123/198 F |
| 4,201,180 | 5/1980 | Iizuka | 123/198 F |
| 4,224,920 | 9/1980 | Sugasawa | 123/198 F |
| 4,249,374 | 2/1981 | Sugasawa | 123/198 F |

*Primary Examiner*—Ronald B. Cox

*Attorney, Agent, or Firm*—Schwartz, Jeffery, Schwaab, Mack, Blumenthal & Koch

[57] ABSTRACT

An internal combustion engine is disclosed which includes a plurality of cylinders split into first and second groups and operates in a split cylinder mode under low engine load conditions where the second group of cylinders are held suspended. Means is provided for holding the combustion chambers of the second group of cylinders in communication with the exhaust passage during a split cylinder mode of operation.

3 Claims, 7 Drawing Figures

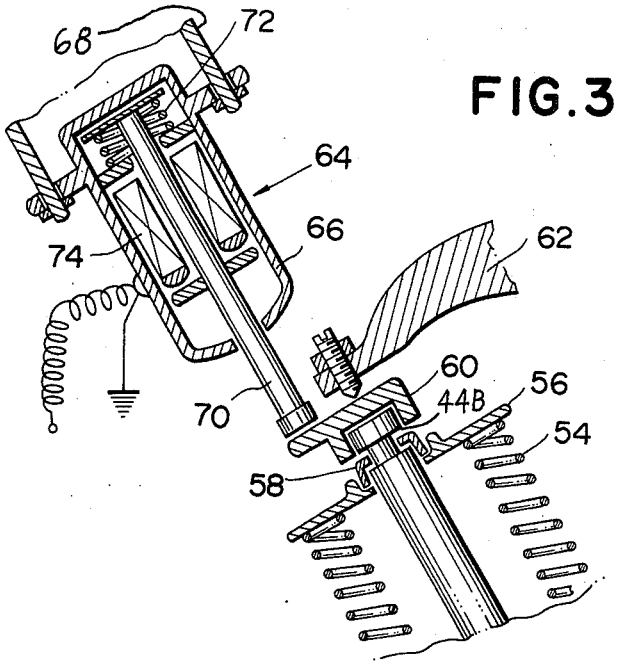
FIG.3
FIG.4
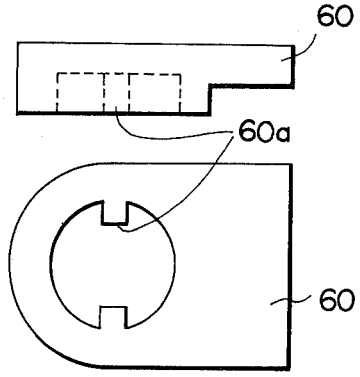
FIG.5
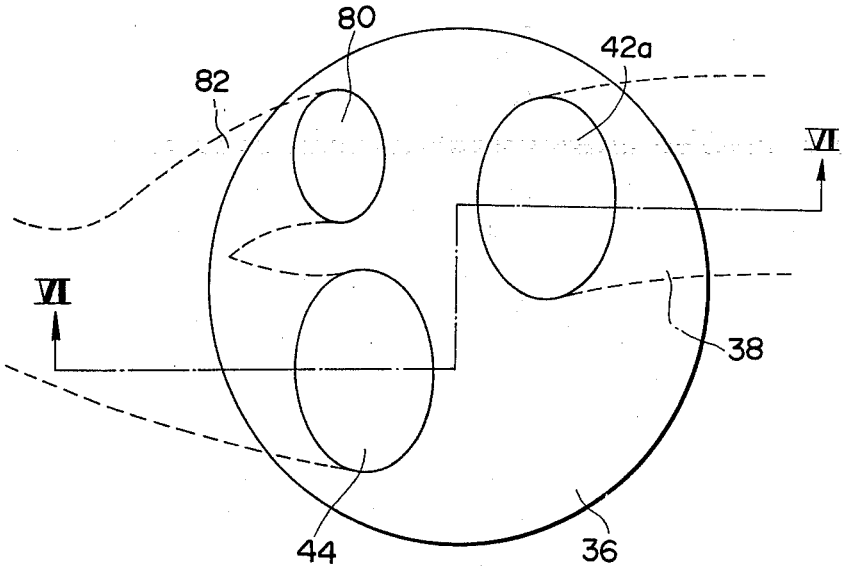

INTERNAL COMBUSTION ENGINE

BACKGROUND OF THE INVENTION

1. Field of the Invention

This invention relates to an internal combustion engine including a plurality of cylinders split into first and second groups and operating in a split cylinder mode under low load conditions where the first group of cylinders are held operative and the second group of cylinders are held suspended and, more particularly, to such an internal combustion engine of cylinders can operate wherein the second group with suppressed pumping loss during a split cylinder mode of operation.

2. Description of the Prior Art

It is generally known that internal combustion engines exhibit higher fuel combustion and thus higher fuel economy when running under higher load conditions. In view of this fact, split type internal combustion engines have already been proposed as automotive vehicle engines or the like subject to frequent engine load variations. Such split type internal combustion engines comprise a plurality of cylinders split into first and second groups, an intake passage provided therein with a throttle valve and bifurcated downstream of the throttle valve into a first branch leading to the first group of cylinders and a second branch leading to the second group of cylinders, an air stop valve provided at the entrance of the second branch for opening and closing the second branch, and control means responsive to engine low load conditions for closing the air stop valve to prevent fresh air from flowing into the second group of cylinders and for cutting off the supply of fuel into the second group of cylinders so as to place the engine in its split cylinder mode of operation. As a result, the other operative cylinders can operate with high loads, which results in high fuel economy.

For higher fuel economy, it is desirable to suppress pumping loss in the second group of cylinders during a split cylinder mode of operation. For this purpose, an attempt has been made to simultaneously close the intake and exhaust valves of the second group of cylinders during a split cylinder mode of operation. However, it requires a sophisticated mechanism for simultaneously closing the intake and exhaust valves of the second group of cylinders, it spoils the stability of rotation of the crank shaft since the pressure developed in the combustion chambers of the second group of cylinders varies in synchronism with the angle of rotation of the crank shaft, and it causes a great amount of oil to be sucked into the combustion chambers and soil them if the engine is placed in its split cylinder mode when the pressure in the combustion chambers is low.

Another attempt has also been made to re-introduce exhaust gases into the second group of cylinders during a split cylinder mode of operation. The effect to suppress pumping loss increases as the amount of exhaust gases re-introduced increases. However, it requires a large diameter exhaust gas re-introduction (EGR) passage with low flow friction and thus a large EGR valve in order to re-introduce, into the second group of cylinders, as great an amount of exhaust gases as possible.

SUMMARY OF THE INVENTION

It is therefore one object of the present invention to provide an improved internal combustion engine which is high in fuel economy.

Another object of the present invention is to provide an improved split type internal combustion engine which is less in pumping loss in its cylinders suspended during a split cylinder mode of operation.

Other objects, means, and advantages of the present invention will become apparent to one skilled in the art thereof from the following description.

BRIEF DESCRIPTION OF THE DRAWINGS

FIGS. 2 and 3 are fragmentary sectional views through a portion of the internal combustion engine showing the valve actuating mechanism of the present invention;

FIG. 4 illustrates the adapter used in the valve actuating mechanism of FIG. 2;

FIG. 5 is a plan view showing a second embodiment of the present invention;

DESCRIPTION OF THE PREFERRED EMBODIMENTS

Figure 1:
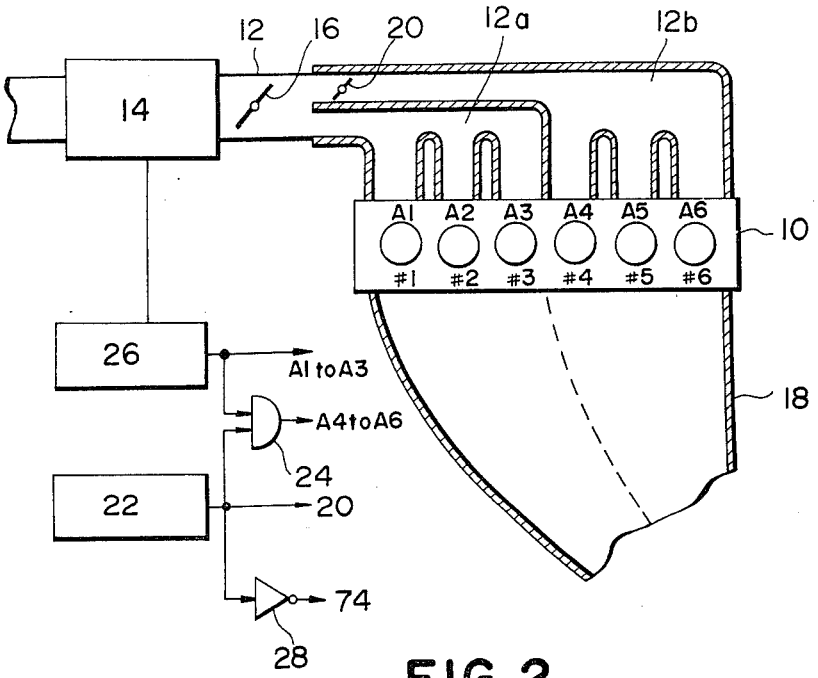
FIG. 1 is a schematic sectional view showing an internal combustion engine embodying the present invention.

Referring now to FIG. 1, there is illustrated one embodiment of an internal combustion engine made in accordance with the present invention. The engine comprises an engine body 10 having a plurality of cylinders #1 to #6 split into first and second groups, an intake passage 12 having therein an airflow sensor 14 and a throttle valve 16 and divided downstream of the throttle valve 16 into first and second branches **12*a* and 12*b*, the first branch 12*a* leading to the first group of cylinders #1 to #3 and the second branch 12*b* leading to the second group of cylinders #4 to #6, and an exhaust passage 18. An air stop valve 20 is provided at the entrance of the second branch 12*b* of the intake passage 12 for opening and closing the second branch 12*b***.

The engine also comprises a load detector circuit 22 which is responsive to engine load conditions for providing a high output signal under high load conditions and a low output signal under low load conditions. The output of the load detector circuit 22 is coupled to one terminal of an AND gate 24, the other terminal of which is coupled to the output of a fuel injection control circuit 26. The fuel injection control circuit 26 has an input from the airflow sensor 14 for providing, in synchronism with rotation of the engine, a fuel injection pulse signal of pulse width dependent upon the amount of air introduced to the engine. The fuel injection pulse signal is applied directly to a first group of fuel injection valves A1 to A3 for supplying fuel into the respective cylinders #1 to #3 and also through the AND gate 24 to a second group of fuel injection valves A4 to A6 for supplying fuel into the respective cylinders #4 to #6. The AND gate 24 is responsive to a high input from the load detector circuit 22 for allowing the fuel injection pulse signal to pass to the second group of fuel injection valves A4 to A6 and responsive to a low input therefrom for blocking the passage of the fuel injection pulse signal to the second group of fuel injection valves A4 to A6.

The load detector circuit 22 may be adapted to detect engine load conditions in accordance with the output of the fuel injection control circuit 26 or with the degree of opening of the throttle valve 16. Additionally, the output of the load detector circuit 22 is coupled to the air stop valve 20 and also through an inverter 28 to solenoid operated valves to be described later. The air stop valve 20 is responsive to a high input from the load detector circuit 22 for opening the second branch 12*b* and responsive to a low input therefrom for closing the second branch 12*b*.

Figure 2:
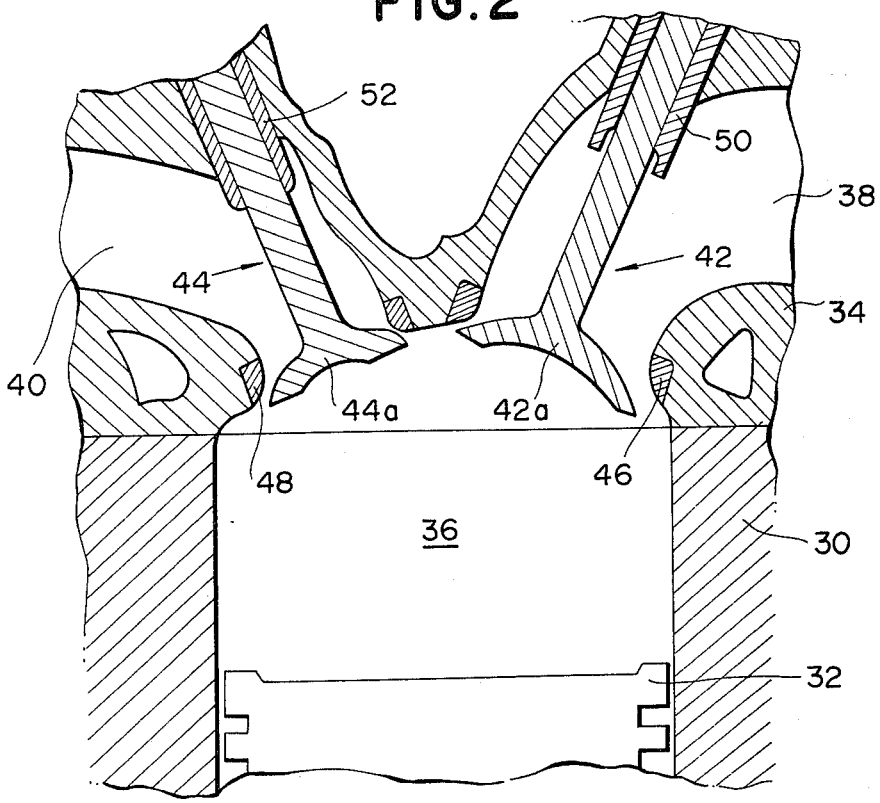

As partly shown in FIG. 2, the engine comprises a cylinder block 30 having a plurality of cylinder bores (only one of which is illustrated) each containing a piston 32 for reciprocating movement therein. A cylinder head 34 is mounted on the cylinder block 30 to close the upper end of the cylinder bore so as to form therewith an expandable combustion chamber 36. The cylinder head 34 is provided with passages opening into the combustion chamber 36, through intake and exhaust ports 38 and 40, the flow therethrough being controlled by intake and exhaust valves 42 and 44, the heads 42*a* and 44*a* of which are adapted to seat against the valve seat inserts 46 and 48 mounted in the intake and exhaust ports 38 and 40, respectively. The intake and exhaust valves 42 and 44 have their valve stems 42*b* and 44*b* reciprocally mounted in valve guides 50 and 52 fitted into valve guide bores extending through the cylinder head 34 and intersecting the passages, respectively, with the upper end of each valve stem projecting above the cylinder head 34.

Referring to FIG. 3, each of the exhaust valves 44 of the second group of cylinders #4 to #6 is normally maintained in a closed position by a return spring 54 with one end of the spring abutting against a spring seat (not shown) on the cylinder head and the other end engaging a spring retainer 56 suitably secured to the valve stem 44*b* by a valve lock 58. Fixed on the upper end of the valve stem 44b is an adapter 60 which may be configurated as shown in FIG. 4 to have stoppers 60*a* engaging the valve stem 44*b* for preventing rotation of the adapter 60.

The exhaust valve 44 is actuated between its closed and open positions by the camshaft timed operation of a rocker arm 62 and held in its open position under low load conditions by the engine load responsive operation of a solenoid operated valve 64. The solenoid operated valve 64 comprises a casing 66 fixed through a support rod 68 to the cylinder head, an actuation rod 70, a return spring 72 urging the actuation rod 70 upward or away from the adapter 60, and a solenoid coil 74 connected through the inverter 28 to the load detector circuit 22. When the output of the load detector circuit 22 is low and thus the output of the inverter 28 is high under low load conditions, the solenoid coil 74 is energized to cause downward movement of the actuation rod 70 to push the exhaust valve 44 through the adapter 60 against the force of the return spring 54 so as to hold the exhaust valve 44 open regardless of the camshaft timed operation of the rocker arm 62. When the output of the load detector circuit 22 is high and thus the output of the inverter 28 is low under high load conditions, the solenoid coil 74 is deenergized and the actuation rod 70 is held out of contact with the adapter 60 by the force of the return spring 72 so that the exhaust valve 44 is operated only by the rocker arm 62 in synchronism with rotation of the camshaft.

The operation of the internal combustion engine of the present invention will now be described. Assuming that the engine is under high load conditions, the load detector circuit 22 provides a high output signal to the air stop valve 20 which is thereby held open and also to the AND gate 24 which is thereby held open. As a result, the engine is in its fuel cylinder mode of operation where all of the cylinders #1 to #6 supplied with fuel and fresh air and held operative.

Furthermore, the high output of the load detector circuit 22 is coupled to the inverter 28 which provides a low signal to the solenoid coils 74 of the solenoid operated valves 64 so as to hold them deenergized. Thus, the exhaust valves 44 of the second group of cylinders #4 to #6 are operated only by the respective rocker arms 62 in synchronism with rotation of the camshaft as well as the exhaust valves of the first group of cylinders #1 to #3.

When the engine load changes to a low condition, the output of the load detector circuit 22 changes to its low level. This causes the air stop valve 20 to close and the AND gate 24 to block the fuel injection pulse signal to the second group of fuel injection valves A4 to A6. As a result, the engine is shifted to its split cylinder mode where the second group of cylinders #4 to #6 are supplied with neither fuel nor fresh air and held suspended.

Furthermore, the output of the inverter 28 changes to its high level which energizes the solenoid coils 74 of the solenoid operated valves 64. This causes the actuation rods 70 to push the valve stems 44*b* so as to open the respective exhaust valves 44 regardless of the camshaft timed operation of the rocker arms 62. As a result, the combustion chambers of the second group of cylinders #4 to #6 are held in communication with the exhaust passage which is larger in volume than these combustion chambers and is held substantially at atmospheric pressure. This is effective to fully suppress pumping loss in the second group of cylinders #4 to #6 during a split cylinder mode of operation.

Additionally, the engine load can be reduced during a split cylinder mode of operation where the rocker arms 62 are free from loads required to open the exhaust valves 44 of the second group of cylinders #4 to #6.

Although only the exhaust valves of the second group of cylinders #4 to 36 are held open during a split cylinder mode of operation in the above embodiment, it is to be noted that both of the intake and exhaust valves of the second group of cylinders #4 to #36 may be held open during a split cylinder mode of operation. This can achieve a further reduction of pumping loss in the second group of cylinders #4 to #6.

Figure 6:
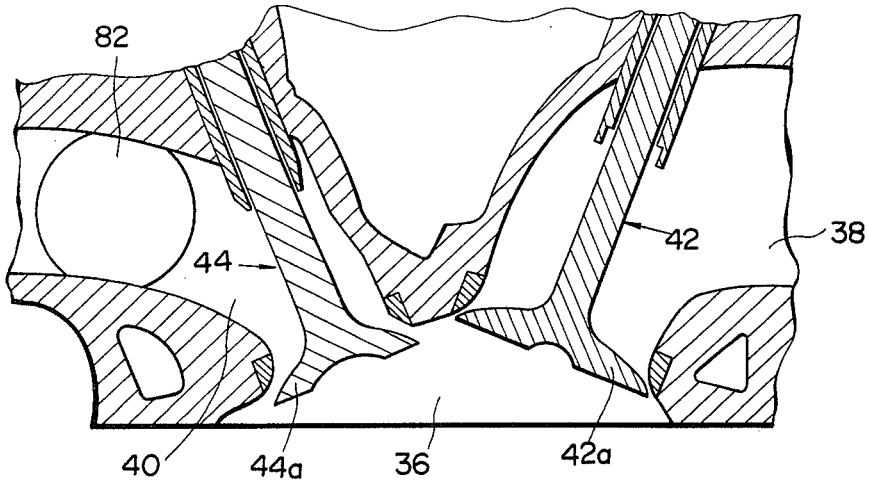
FIG. 6 is a fragmentary sectional view taken along the line VI—VI of FIG. 5.

Referring to FIGS. 5 and 6, there is illustrated a second embodiment of the present invention which is substantially similar to the first described embodiment except that the solenoid actuators 64 of FIG. 3 are removed and instead a solenoid operated valve 80 is provided for opening and closing each of the passages 82 extending through the cylinder head 34 for communication of the combustion chambers of the second group of cylinders #4 to #6 with their exhaust ports 40, respectively. Each of the solenoid operated valves 80 is responsive to a low signal from the inverter 28 for closing the corresponding passage 82 and is responsive to a high signal therefrom for opening the corresponding passage 82. Thus, during a split cylinder mode of operation, the combustion chambers of the second group of cylinders #4 to #6 are held in communication with their exhaust ports so as to effectively suppress pumping loss in the second group of cylinders #4 to #6 as described in connection with the first embodiment.

Figure 7:
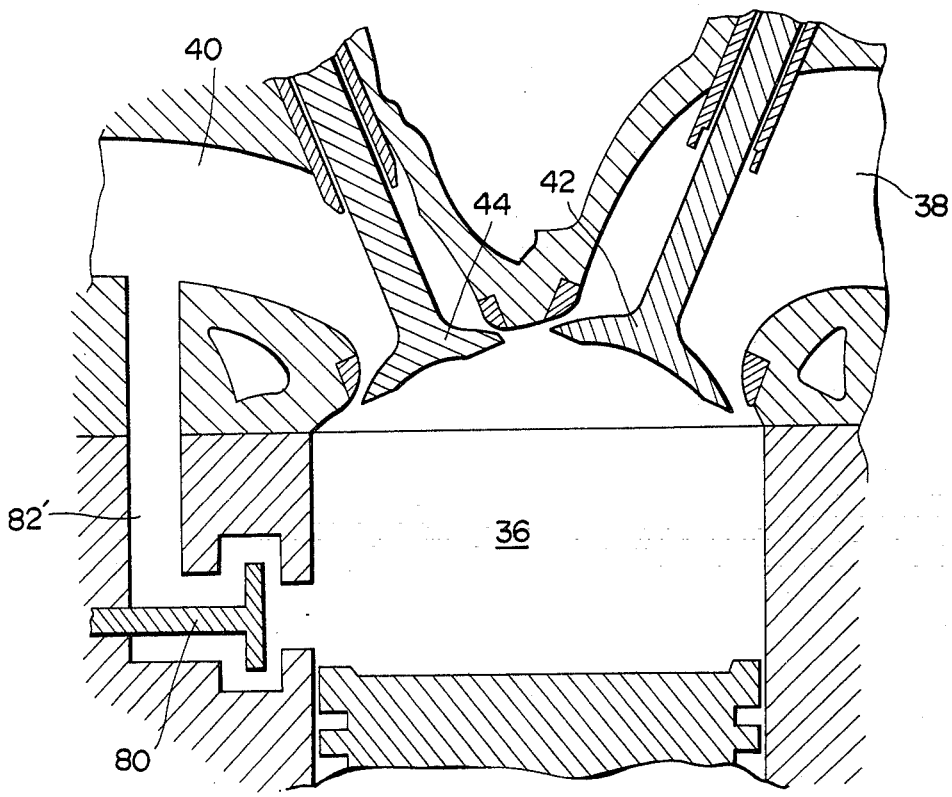
FIG. 7 is a fragmentary sectional view showing a third embodiment of the present invention.

Referring to FIG. 7, there is illustrated a third embodiment of the present invention which is substantially similar to the second embodiment except that each of the passages 82' extends through the cylinder block 30, with one end of the passage opening into the cylinder bore and the other end thereof opening into the exhaust port 40.

There has been provided, in accordance with the present invention, an improved internal combustion engine which can operate in a split cylinder mode where some of the cylinders are supplied neither fuel nor fresh air and held suspended for high fuel economy under low load conditions and in which the combustion chambers of the suspended cylinders are held in communicated with the exhaust passage to suppress pumping loss in the suspended cylinders for higher fuel economy during a split cylinder mode of operation. While the present invention has been described in conjunction with specific embodiments thereof, it is evident that many alternatives, modifications and variations will be apparent to those skilled in the art. accordingly, it is intended to embrace all alternatives, modifications that fall within the spirit and broad scope of the appended claims.

What is claimed is:

1. An internal combusion engine comprising:

(a) first and second cylinder units each including at least one cylinder having a combustion chamber defined by a cylinder block and a cylinder head mounted on said cylinder block, each of said combustion chambers being connected through an exhaust valve to an exhaust port formed in said cylinder head;

(b) a bypass passage associated with each cylinder of said second cylinder unit, said bypass passage opening at its one end into said exhaust port and at the other end into said combustion chamber providing communication therebetween to bypass said exhaust valve;

(c) a bypass valve provided in said bypass passage, said bypass valve being normally in its closed position to interrupt communication between said exhaust port and said combustion chamber; and (d) control means responsive to engine low load conditions for disabling said second cylinder unit and placing said bypass valve into its open position to provide said communication between said exhaust port and said combustion chamber.

2. An internal combustion engine according to claim 1, wherein said bypass passage extends through said cylinder block between said exhaust port and said combustion chamber.

3. An internal combustion engine according to claim 1, wherein said bypass passage extends through said cylinder head between said exhaust port and said combustion chamber.

* * * * *